US008284983B2

(12) United States Patent
Reck

(10) Patent No.: US 8,284,983 B2
(45) Date of Patent: Oct. 9, 2012

(54) COAXIAL LOUDSPEAKER

(75) Inventor: Klaus Reck, Kaltenkirchen (DE)

(73) Assignee: Klaus Reck, Kaltenkirchen (DE)

( * ) Notice: Subject to any disclaimer, the term of this patent is extended or adjusted under 35 U.S.C. 154(b) by 1267 days.

(21) Appl. No.: 11/858,171

(22) Filed: Sep. 20, 2007

(65) Prior Publication Data

US 2009/0046876 A1 Feb. 19, 2009

(30) Foreign Application Priority Data

Aug. 14, 2007 (EP) ..... 07114327

(51) Int. Cl.
*H04R 1/00* (2006.01)

(52) U.S. Cl. ..... 381/423; 381/386

(58) Field of Classification Search ..... 381/423, 381/386

See application file for complete search history.

(56) References Cited

U.S. PATENT DOCUMENTS

| | | | | |
|---|---|---|---|---|
| 3,637,039 | A * | 1/1972 | Raichel et al. | 181/146 |
| 5,398,288 | A | 3/1995 | Kizak | |
| 6,343,128 | B1 * | 1/2002 | Coffin | 381/186 |
| 6,876,752 | B1 * | 4/2005 | Guenther | 381/386 |

FOREIGN PATENT DOCUMENTS

| | | | |
|---|---|---|---|
| DE | 941674 | | 4/1956 |
| DE | 30 02 84 3 | | 7/1981 |
| DE | 30 02 843 | | 7/1981 |
| DE | 8610875 | U | 6/1986 |
| DE | 10232118 | | 10/2003 |
| EP | 0 164 942 | A2 | 12/1985 |
| EP | 0 242 856 | A2 | 10/1987 |
| EP | 1 515 584 | A1 | 3/2005 |
| EP | 1 5155 584 | A1 | 3/2005 |
| GB | 2 335 821 | A | 9/1999 |
| JP | 53 070 808 | A | 6/1978 |
| JP | 2005-322987 | A | 11/2005 |
| JP | 2007-219336 | A | 8/2007 |
| WO | WO86/00189 | | 1/1986 |

* cited by examiner

*Primary Examiner* — Jianchun Qin
(74) *Attorney, Agent, or Firm* — Sampson & Associates, P.C.

(57) ABSTRACT

A coaxial loudspeaker including a tweeter unit and a low/midrange unit with a cone diaphragm suspended in a loudspeaker basket, which comprises an electromagnetic drive fixedly attached to a loudspeaker basket on its tapered end, in the area of which the tweeter unit is positioned, whose sound radiation surface is directed away from this drive. In one embodiment, in order to suppress the sound focusing of traditional coaxial loudspeakers with a woofer/midrange cone diaphragm, and to ensure a simple and cost-efficient assembly of the tweeter unit, the electromagnetic drive for the cone diaphragm of the woofer/midrange unit is located within the space bordering the convex curved exterior side of the cone diaphragm, and the tweeter unit is positioned outside of this space.

11 Claims, 3 Drawing Sheets

COAXIAL LOUDSPEAKER

CROSS REFERENCES TO RELATED APPLICATIONS

This application claims the priority benefit of European Patent Application No. 07 114 327.5 filed on Aug. 14, 2007.

STATEMENT REGARDING FEDERALLY SPONSORED RESEARCH

Not Applicable.

DESCRIPTION OF THE BACKGROUND ART

The field of invention is a coaxial loudspeaker, comprising a tweeter unit and a low/midrange unit with a cone diaphragm suspended in a loudspeaker basket, which includes an electromagnetic drive fixedly attached to the loudspeaker basket on its tapered end, in the area of which is positioned the tweeter unit, whose sound radiation surface is directed away from this drive.

A characteristic feature of existing coaxial loudspeakers, such as the coaxial loudspeakers described in publications DE-PS 941 674, DE-102 32 118 C1, DE 86 10 875 U1, and DE 92 10 463 U1, is that a tweeter unit is positioned within the cone diaphragm of the woofer/midrange unit forming an acoustic horn. Of the aforementioned publications, DE 86 10 875 U1 describes a coaxial loudspeaker of the type initially mentioned, with the positioning of the tweeter unit on the tapered end of the acoustic horn, fixedly attached to the loudspeaker basket of the woofer/midrange unit.

The disadvantages of this existing coaxial loudspeaker are that because of the acoustic horn principle used, the sound is radiated with increasingly stronger focus as frequency increases, and the high-end response is distorted due to the embedding of the tweeter unit in the acoustic horn. The mounting of the tweeter unit also requires additional parts.

There are also coaxial speakers with flat or convex woofer/midrange units of the prior art that do not suffer from the problems associated with coaxial loudspeakers based upon an acoustic horn. In these coaxial loudspeakers, however, the positioning of the tweeter unit requires even more additional parts and increased assembly effort. Moreover, these coaxial loudspeakers are characterized by a complex supporting structure for the tweeter unit.

SUMMARY OF THE INVENTION

The objective of the invention is therefore to create a coaxial loudspeaker of the type initially mentioned that does not suffer from the sound focusing caused by the acoustic horn found in traditional coaxial loudspeakers with a woofer/midrange cone diaphragm, and which ensures a simple and cost-efficient assembly of the tweeter unit.

The objective of this invention is achieved in one embodiment by providing coaxial loudspeaker including a tweeter unit and a woofer/midrange unit with a cone diaphragm suspended in a loudspeaker basket. An electromagnetic drive is fixedly attached to the loudspeaker basket on its tapered end, in the area of which the tweeter unit is positioned, whose sound radiation surface is directed away from this drive. The electromagnetic drive for the cone diaphragm of the woofer/midrange unit is within the space bordering the convex curved exterior of the cone diaphragm, and the tweeter unit is positioned outside of this space.

Advantageously, in one embodiment, the initially mentioned coaxial loudspeaker is structured so that the sound in lower and midrange frequencies does not radiate in a traditional manner through the acoustic horn of the woofer/midrange unit, i.e. via the convex curved interior side of its cone diaphragm, but rather over its exterior side through the loudspeaker basket. There is no sound focusing of lower and midrange frequencies, and also no distortion of higher frequencies when the tweeter unit is positioned in the cone diaphragm of the woofer/midrange unit, which in one embodiment is located on the concave curved exterior side of the cone diaphragm.

With respect to radiation characteristics, therefore, the coaxial loudspeaker corresponds to coaxial loudspeakers of the prior art with a convex woofer/midrange diaphragm, without their disadvantage in terms of complexity of the supporting structure, particularly in the mounting of the tweeter unit. Based upon the loudspeaker basket positioned in the direction of sound radiation, this loudspeaker basket can be advantageously used for a simple mounting of the tweeter unit, namely externally on its tapered end.

The embodiment has the advantage of a simple and effective mounting for the electromagnetic drive of the woofer/midrange unit's cone diaphragm. In one embodiment, the spacer provided for this purpose is in the form of a cup, and in addition to a stable mounting of the electromagnetic drive for the woofer/midrange unit, the cup has the advantage that it can form a suitable resonance chamber for the tweeter unit.

To the extent that a woofer/midrange unit is discussed here, this refers to a loudspeaker and/or loudspeaker component that generates low and middle frequencies. Here, however, the designation woofer/midrange unit also refers to a pure midrange unit that generates exclusively middle frequencies of the auditory spectrum or a pure woofer that generates exclusively low frequencies of the auditory spectrum.

BRIEF SUMMARY OF THE DRAWINGS

The preferred embodiment incorporating the present invention is explained in greater detail below based upon the drawings. These show.

DETAILED DESCRIPTION OF THE PREFERRED EMBODIMENTS

Figure 1:
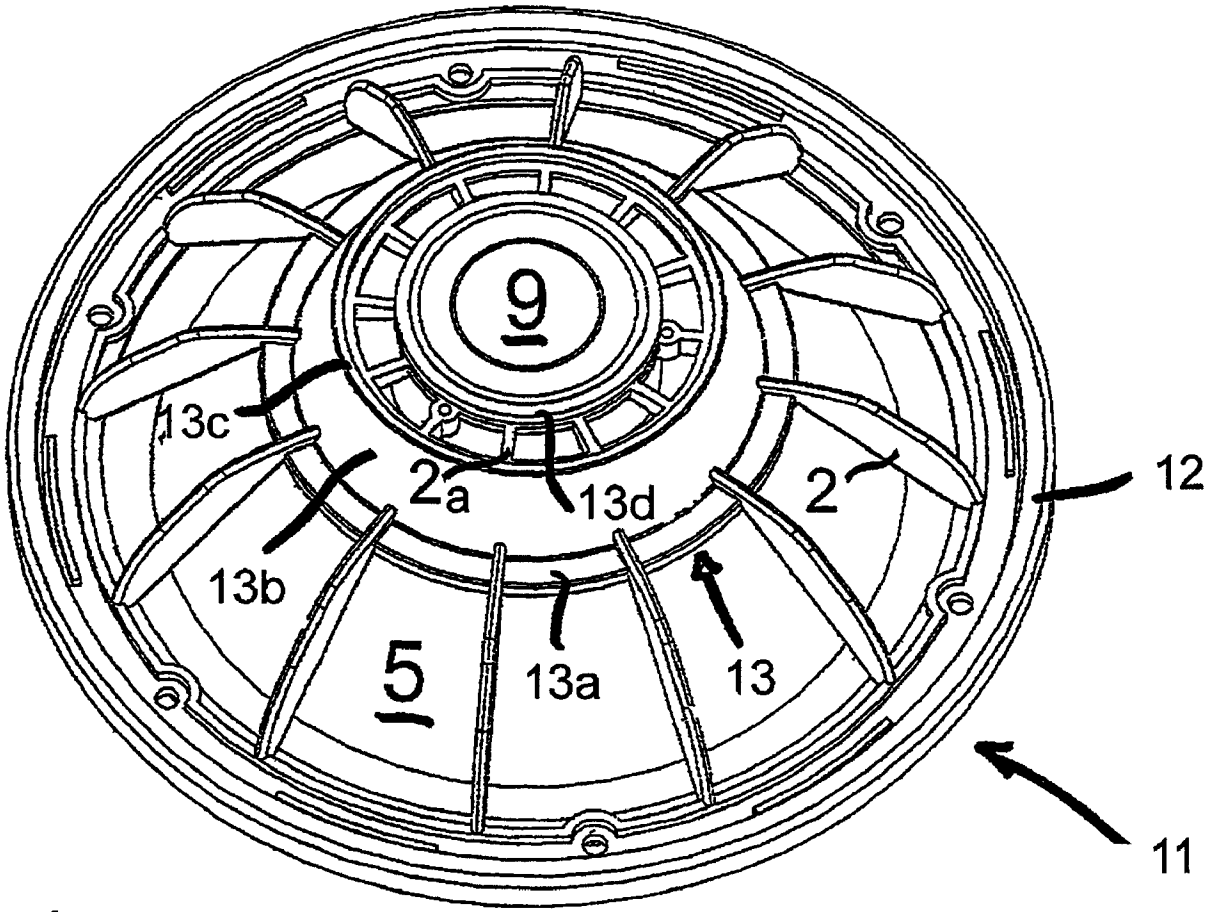
FIG. 1 is a top view of an embodiment of the coaxial loudspeaker incorporating the invention, wherein a ring of sound-absorbing material on the base of a loudspeaker basket is removed.
Figure 2:
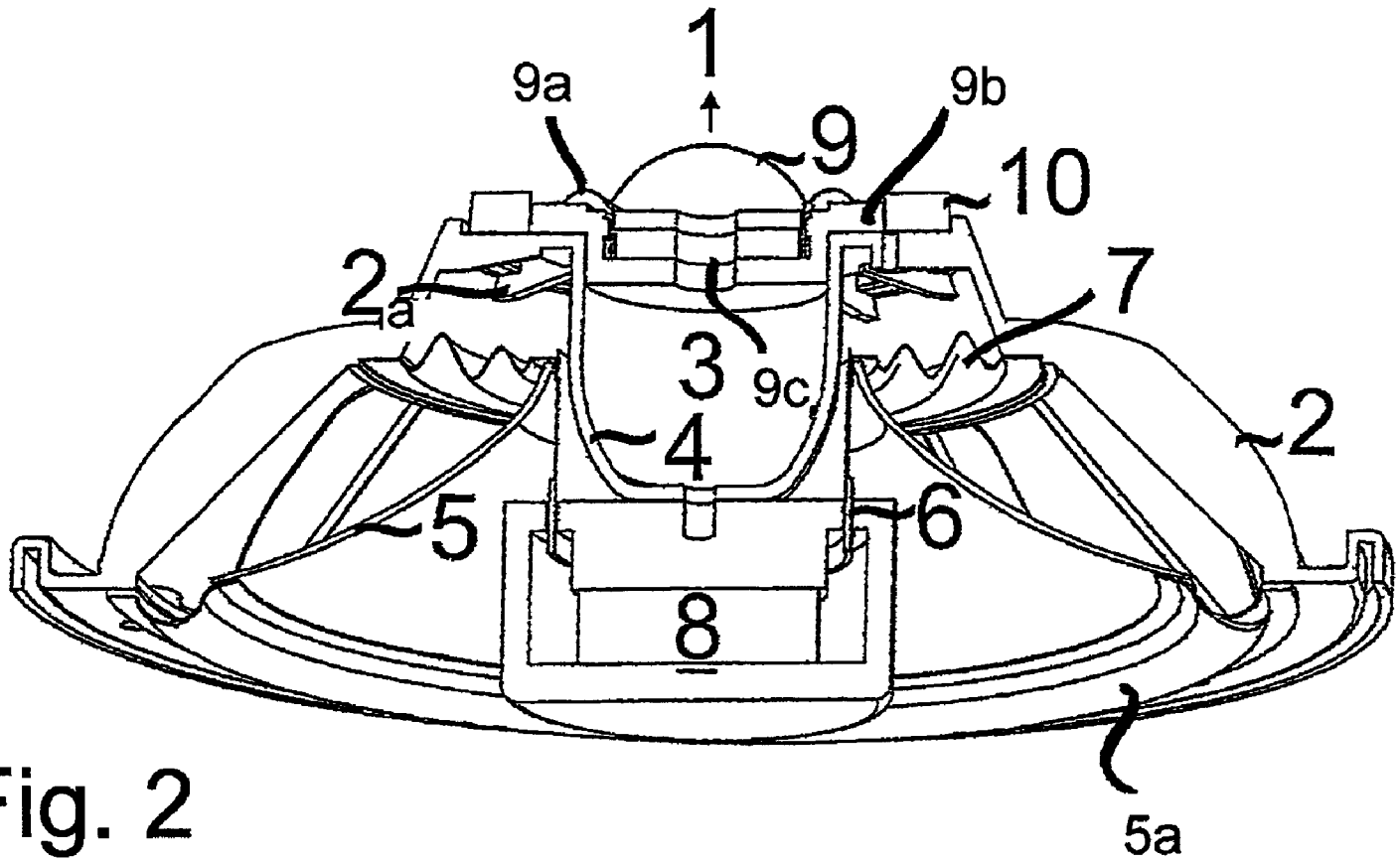
FIG. 2 is a cross-section of the coaxial loudspeaker from FIG. 1, wherein the ring of sound-absorbing material is positioned on the base of a loudspeaker basket.
Figure 3:
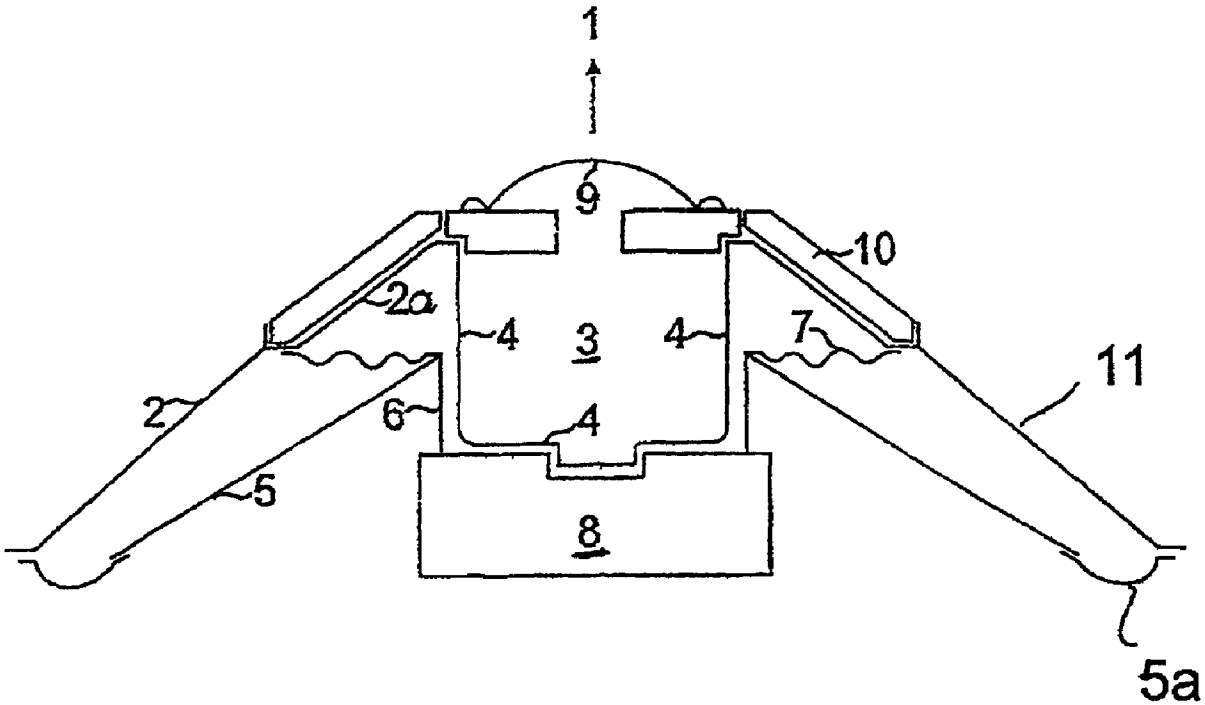
FIG. 3 is a strongly schematic presentation of the view from FIG. 2, wherein the ring of sound-absorbing material has a larger surface area than in FIG. 2 and is located in the area of a cone-shaped perforated base part of the loudspeaker basket.

The coaxial loudspeaker shown in FIGS. 1 through 3 comprises a loudspeaker basket 11 with an outer mounting ring 12 forming the rim of the basket, and a small-diameter inner retaining ring 13 forming the base of the basket 11, arranged axially offset in relation to the mounting ring 12 and connected with the mounting ring 12 by means of bracing struts 2, which extend radially at equal intervals from one another to the two rings 12, 13.

The inner retaining ring 13 comprises an external flat ring section 13*a*, a general cone-shaped intermediate section 13*b* which then connects inwardly, and an internal flat ring section 13*c*, which is connected with a supporting ring 13*d* by means of bracing struts 2*a* which extend radially at equal intervals from one another.

Loudspeaker basket 11 forms in a known manner part of a woofer/midrange unit, which in other respects comprises a cone diaphragm 5, whose larger diameter rim is suspended across a bead 5*a* on the basket rim and whose smaller diameter rim is suspended across a centering spider 7 on ring section 13*a* of loudspeaker basket 11. Preferably, the loudspeaker basket 11 is a die cast part made primarily of an aluminum alloy.

The tweeter unit of the coaxial loudspeaker is in the form of a domed tweeter unit, and thus comprises a dome 9, which is clamped on the rim side across a bead 9*a* to a ring structure 9*b*, which contains an electromagnetic drive not shown in detail, and a central through-hole 9*c*. The tweeter unit is set in a cup 4 and glued with its rim. The cup 4 is formed as a single piece with supporting ring 13*d* and extends into the loudspeaker basket 11. The cup 4 determines the resonance volume of the tweeter unit, whose through-hole 9*c* opens into the interior of cup 4. The electromagnetic drive 8 is permanently attached to the exterior side of the level base of cup 4. By means of this arrangement, drive 8 is positioned at least essentially within the space bordering the convex curved exterior side of cone diaphragm 5. In a known manner, the voice coil 6 of the woofer/midrange unit connected with the inner rim of cone diaphragm 5 extends through an annular clearance into the permanent magnet of drive 8.

A ring 10 made of sound-absorbing material is arranged externally across brace struts 2*a* and covers the interim spaces between brace struts 2*a* ab. This ring 10, which is located above the centering spider in the direction of sound radiation 1 absorbs sound across the middle frequency range that is radiated by cone diaphragm 5 at a level that is lower than the useful signal level of the woofer/midrange unit.

While there have been shown and described what is at present considered the preferred embodiments of the invention, it will be obvious to those skilled in the art that various changes and modifications can be made therein without departing from the scope of the invention defined by the appended claims.

I claim:

1. A coaxial loudspeaker, comprising:

a first frequency generating unit including a cone diaphragm suspended in a loudspeaker basket, and an electromagnetic drive disposed at a tapered end of the cone diaphragm;

a second frequency generating unit having a sound emitting surface, the second frequency generating unit being fixed to the loudspeaker basket with its sound emitting surface facing away from the electromagnetic drive;

the electromagnetic drive being disposed within a space surrounded by the convexly curved outer side of the cone diaphragm;

the second frequency generating unit being disposed outside the space; and wherein the first frequency generating unit is configured to emit sound through an open region between bracing struts of the loudspeaker basket in a direction away from the electromagnetic drive.

2. The coaxial loudspeaker according to claim 1, in which the second frequency generating unit is attached to a base of the loudspeaker.

3. The coaxial loudspeaker according to claim 1, in which the electromagnetic drive for the cone diaphragm of the first frequency generating unit is mounted to a base of the loudspeaker basket by a spacer.

4. The coaxial loudspeaker according to claim 3, in which the spacer is in the form of a cup, whose base supports the electromagnetic drive and whose rim is connected with a reverse side of the second frequency generating unit and defines a resonance chamber.

5. The coaxial loudspeaker according to claim 4, in which the cup is formed as a single piece with the loudspeaker basket.

6. The coaxial loudspeaker according to claim 1, including a cover made of high-frequency absorbing material is positioned in front of a centering spider for a cone diaphragm.

7. The coaxial loudspeaker according to claim 1, in which a diaphragm of the second frequency generating unit has a spherical surface.

8. The coaxial loudspeaker according to claim 1, in which the loudspeaker basket is a die cast part made primarily of an aluminum alloy.

9. The coaxial speaker according to claim 1, in which said first frequency generating unit is selected from a group consisting of woofer unit, a midrange unit, and a combination woofer and midrange unit.

10. The coaxial speaker according to claim 1, in which said second frequency generating unit is a tweeter.

11. The coaxial speaker according to claim 1, in which the cone diaphragm is suspended in a loudspeaker basket between an inner ring and an outer ring thereof, said inner ring and said outer ring spaced from one another to define a conical space therebetween which is sized and shaped to receive said cone diaphragm therein, said outer ring being spaced from said inner ring in a direction facing away from that faced by said sound emitting surface of the second frequency generating, unit.

* * * * *